US005482510A

United States Patent [19]

Ishii et al.

[11] Patent Number: 5,482,510

[45] Date of Patent: Jan. 9, 1996

[54] AMUSEMENT DEVICE PASSING WITHIN TUBE

[75] Inventors: Hiroji Ishii; Masanori Tamada; Satoru Yoshida, all of Tokyo; Isamu Okuzumi, Omiya, all of Japan

[73] Assignee: Ishii Iron Works Co., Ltd., Tokyo, Japan

[21] Appl. No.: 137,905

[22] Filed: Oct. 15, 1993

[30] Foreign Application Priority Data

Oct. 23, 1992 [JP] Japan ..... 4-307853

[51] Int. Cl.[6] ..... A63F 7/00

[52] U.S. Cl. ..... 472/61

[58] Field of Search ..... 472/61, 116, 117, 472/58, 59, 72, 74; 446/267; 362/84

[56] References Cited

U.S. PATENT DOCUMENTS

| | | | |
|---|---|---|---|
| 2,649,123 | 6/1953 | Etzkorn | 362/84 X |
| 4,181,925 | 1/1980 | Burrows | 362/84 X |
| 4,362,299 | 12/1982 | Suzuki | 273/85 R |
| 4,738,888 | 4/1988 | Pantaleo et al. | 446/267 X |
| 4,779,166 | 10/1988 | Tanaka et al. | 367/84 X |
| 4,942,504 | 7/1990 | Brotz | 362/84 |
| 5,047,267 | 4/1991 | Pantaleo et al. | 446/267 X |
| 5,104,699 | 4/1992 | Pantaleo et al. | 446/267 X |
| 5,128,846 | 7/1992 | Mills et al. | 362/84 X |
| 5,156,550 | 10/1992 | Alexander | 446/267 X |
| 5,211,467 | 5/1993 | Seder | 362/84 |

*Primary Examiner*—Carl D. Friedman
*Assistant Examiner*—Beth A. Aubrey
*Attorney, Agent, or Firm*—Hedman, Gibson & Costigan

[57] ABSTRACT

An amusement device passing within a tube is made into a device which is safe in operation while passing within a dark tube, giving a mild and fantastic mood to a sight feeling of a rider to enable the rider to enjoy modern leisure characteristics or joyfulness and then a picture drawn on the inner wall surface with fluorescent substance and an illuminating device for radiating ultraviolet rays to the picture are arranged so as to cause a rider to play in the amusement device and to enable a stereoscopic light emitting image to be attained on the inner wall surface of the tube.

9 Claims, 2 Drawing Sheets

AMUSEMENT DEVICE PASSING WITHIN TUBE

BACKGROUND OF THE INVENTION

This invention relates to a large-sized amusement device, passing within a tube such as an amusement device of a waterslide in which water flows through the tube of various shapes, linear line, spiral or other and persons ride down the course on a float floated on the stream in the tube, or an amusement device of a dryslide where persons slide down the course on the dried sliding surface in the tube from the uppermost part to the lowermost part, or an amusement device where persons run the course on a cart in the tube, or an amusement device where persons pass through the tube from the lowermost part to the uppermost part to enjoy and the like.

A large-sized amusement device in the prior art where persons pass through a tube is introduced in the Publication Gazette of Japanese Utility Model, Japanese Utility Model Publication No. 3-34223, for example, as an amusement device of a slide where persons slide down the dried sliding surface or the water flowing slide in the tube, the Laid-Open Gazette of Japanese Utility Model, Japanese Utility Model Laid-Open No. 3-27290, for example, as an amusement device of waterslide where persons ride and play on a float floated on the stream in the tube and the Laid-Open Gazette of Japanese Patent Laid-Open No. 1-170491, for example, as an amusement device where persons ride on a cart and run down the course in the tube and they are widely known and utilized.

These large-sized amusement devices as described above were operated to cause the riders to ride on the cart or run in the tube of a linear shape or a curved shape or bent shape or these combined shapes from the uppermost part to the lowermost part, run through the tube while sliding on the sliding surface or ride on the float floated on the stream. However, as the field of view of the riders were shielded by the wall of the tube when the riders pass through the tube, the leisure characteristics to be obtained through the sight sensing or fun was a little insufficient. In these aforesaid amusement devices, there were possibilities of the riders getting neck injury while passing through the tube due to an accidental variable shock if the advancing direction in the tube changes suddenly since the riders pass in the dark tube when the amusement device is operated at night or when the amusement device of opaque tube wall is used.

In addition, as the amusement device giving leisure feature or fun to the sight sensing of the rider while passing through the tube, there is an invention of the device where the continuous illustration is drawn at the inner wall surface of the tube or projected or illustrated there (Japanese Patent Appln. No. 3-119055) or an invention of the device where the continuous light source illumination is arranged on the inner wall surface of the tube (Japanese Patent Appln. No. 3-119054) as the applications of the present applicant, for example.

However, the invention of Japanese Patent Appln. No. 3-119055 of the aforesaid inventions is the device where the illustration or continuous illustration of scene or the like, being arranged on the inner wall surface of the tube, shall become an active image when the riders pass through the tube, thus enabling riders to enjoy a feeling of speed, thrill and sensitive emotion. The invention of Japanese Patent Appln. No. 3-119054 of the aforesaid inventions is the device where the continuous light source illumination arranged on the surface of the inner wall of the tube and the movements of the riders are combined each other to give the riders a feeling of speed and thrill. However, these aforesaid inventions are not suitable to enjoy a mild and fantastic mood or stereoscopic image, as the inside of the tube is relatively light and the joyful feeling that can be obtained through the sight sensing is of plain type and dynamic.

As described above, the prior art amusement device is not suitable for ensuring the safety of the riders and giving a mild, fantastic mood or stereoscopic image applealing to the riders through the sight feeling, matching the modern trends when the riders are passing through the closed and relatively dark tube.

SUMMARY OF THE INVENTION

This invention provides a safe amusement device in which the stereoscopic image is realized and the riders can experience a mild and fantastic mood and further enjoy a modern leisure or joy when the riders are passing through the dark tube.

This invention is completed to solve the aforesaid problems. This amusement device in which the riders can enjoy passing through the tube is constructed such that a picture drawn on the inner wall surface with fluorescent substance and an illuminating device for illuminating ultraviolet rays to the picture will realize the stereoscopic image on the inner wall surface of the tube.

As the aforesaid illuminating device, an ultraviolet projecting lamp for radiating ultraviolet rays with a wave length of 280 nm to 400 nm is used.

The aforesaid picture is covered by a transparent and ultraviolet rays passable sheet or a masking material such as transparent coating materials and the like.

The aforesaid illuminating device is provided with a protection cover of which the ultraviolet rays radiating side is transparent to allow passage of ultraviolet rays and the side of which the riders advance is light-shielded.

This amusement device in which the riders pass through the tube is constructed from a tubular passage reflecting the ultraviolet rays on the inner wall surface of the dark interior of the tubular passage, a picture drawn on the inner wall surface of the tubular passage with fluorescent substance and the illuminating device for illuminating the ultraviolet rays to the picture.

The aforesaid tubular passage is formed by a tube having a circular section with fiber reinforced plastic material, wherein the inner-most surface acting as the inner wall surface is formed into the reflection surface of the gel-coated layer.

In addition, the amusement device in which the riders pass through the tube is constructed such that it is provided with the flowing members formed of liquid or solid fluorescent substance flowing within the tube of the dark interior and the illuminating device for illuminating the ultraviolet rays to the flowing members formed by fluorescent substance.

In addition, the aforesaid flowing members are formed into some spherical or flat-shaped solid materials.

The amusement device in which the riders pass through the tube of the present invention has the picture drawn on the inner wall surface with fluorescent substance so as to get the stereoscopic fluorescent image on the inner wall of the tube and the illuminating device for radiating the ultraviolet rays to the picture, so that when the ultraviolet rays are radiated within the tube, the picture drawn on the inner wall surface of the tube becomes the image emitting light with a lightness difference and a tone difference to emit, resulting in that the stereoscopic light emitting image can be attained to let the eyes of the riders passing through the tube enjoy.

Since the ultraviolet rays illuminating lamp radiating the ultraviolet rays with the wave length range of 280 nm to 400 nm or the like is used as the aforesaid illuminating device, the wave length range of the ultraviolet rays which may be easily absorbed by air or the wave length range influencing a strong chemical action against living things is eliminated. In addition, as the ultraviolet rays of the wave length effective to the human body is contained in the above wave length, this illuminating device can be used efficiently and economically without sacrificing the safety.

The front surface of the aforesaid picture is covered and protected by a transparent sheet allowing passage of ultraviolet rays or the masking material such as transparent coating and the like, therefore, the picture may not be damaged even if the riders pass by it or water or objects are contacted or struck against the picture. In addition, the emitting of fluorescent substance at the picture may not be hindered.

Since the aforesaid illuminating device is protected by a cover of which the ultraviolet rays radiating side is transparent to allow passage of ultraviolet rays and the side to where the riders advance is shielded, the riders are protected from crashing damages or the broken pieces of the lamp from dispersing over. At the same time, the presence of the illuminating device is veiled by the shield from the eyes of the riders advancing in the tube, the fantastic effects are more improved.

The amusement device passing through the tube, comprising of a tubular passage with a surface reflecting the ultraviolet rays on the inner wall surface of the dark interior of the tubular passage, a picture drawn on the inner surface of the tubular passage by a fluorescent substance and an illuminating device for radiating the ultraviolet rays to the picture is operated in such a way as that the ultraviolet rays radiated from the illuminating device may repeat its reflection on the inner wall surface of the tubular passage without dispersing light or attenuating by losing direction characteristic on the inner wall surface of the tubular passage acting as the reflecting surface. The direct light from the illuminating device and the reflection light is well balanced to illuminate the inner wall surface of the tubular passage under a substantially uniform lux of the ultraviolet rays. The fluorescent substance of the picture drawn on the inner wall surface of the tubular passage may receive the balanced substantially uniform radiation of the ultraviolet rays to produce the fluorescent color having a lightness difference. The picture is floated up by the fluorescent light to generate the stereoscopic fantastic space. The space within the tubular passage generates a mild and fantastic mood to improve the playing characteristics of the device and at the same time the riders can enjoy the space while passing through there. In addition, since the fantastic space generated by the stereoscopic light emitted image is formed in an advancing direction of the dark tubular passage, the riders may not get any accidental variation or shock to injure their necks as the riders can see the light emitted image with their eyes in the advancing direction in advance even though the direction of the tubular passage should be changed suddenly and thus the amusement device of the present invention is safe in its operation.

The tubular passage is formed into the tube having the circular sectional shape with fiber reinforced plastic material and the innermost surface acting as the inner wall surface is formed into the reflection surface of the gel-coated layer, so that a smooth and hardened rigidity can be attained, a safety or a durability can be improved and an economical formation can also be attained.

The amusement device passing within the tube with the flowing members formed by liquid or solid fluorescent substance flowing within the tube of the dark interior and the illuminating device for radiating the ultraviolet rays to the flowing members formed by the fluorescent substance is operated such that if the tube is placed from the upper part toward the lower part, for example, the flowing members flow down freely by their own weights within the tube together with the riders, while generating the fluorescent light upon receiving the ultraviolet rays at a faster or slower than or at the same speed as the descending speed of the riders, within the tube arranged from the upper part to the lower part, so that the riders can descend joyfully within the tube while being enclosed by the flowing members generating fantastic fluorescent light and immersing in the dynamic but mild and fantastic atmosphere. In addition, it is possible to improve a playing characteristics of the device and improve an efficiency in utilization. In addition, since the flowing members suggest the advancing direction of the tube while generating the fluorescent light within the dark tube, the riders may not get the accidental variation and shock of damaging at the neck and can play safely.

Since the flowing members are formed into the spherical or flat-shaped solid members, the flowing members may jump or roll generating fluorescent light while descending down, therefore, their outer appearance is good and felt at the body of each of the riders and the playing characteristic is further improved.

DETAILED DESCRIPTION OF THE PREFERRED EMBODIMENTS

Figure 1:
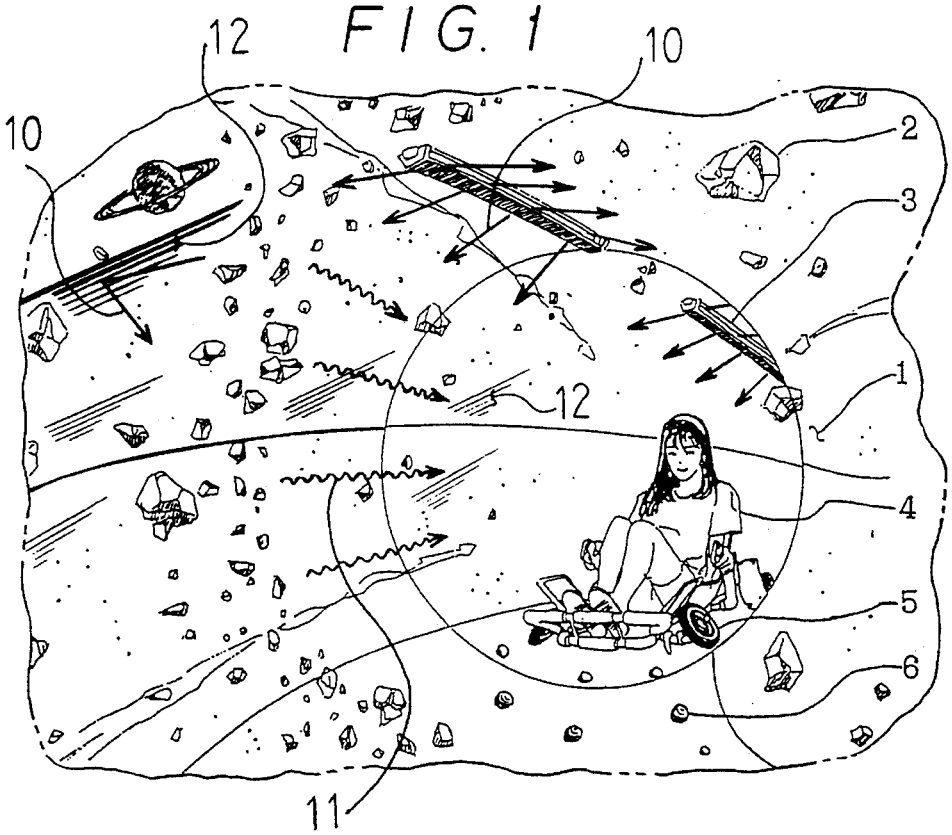
FIG. 1 is a partial perspective illustration showing a preferred embodiment of the amusement device of the present invention.

The preferred embodiments of the present invention will explained hereinunder, referring to the drawings.

Figure 2:
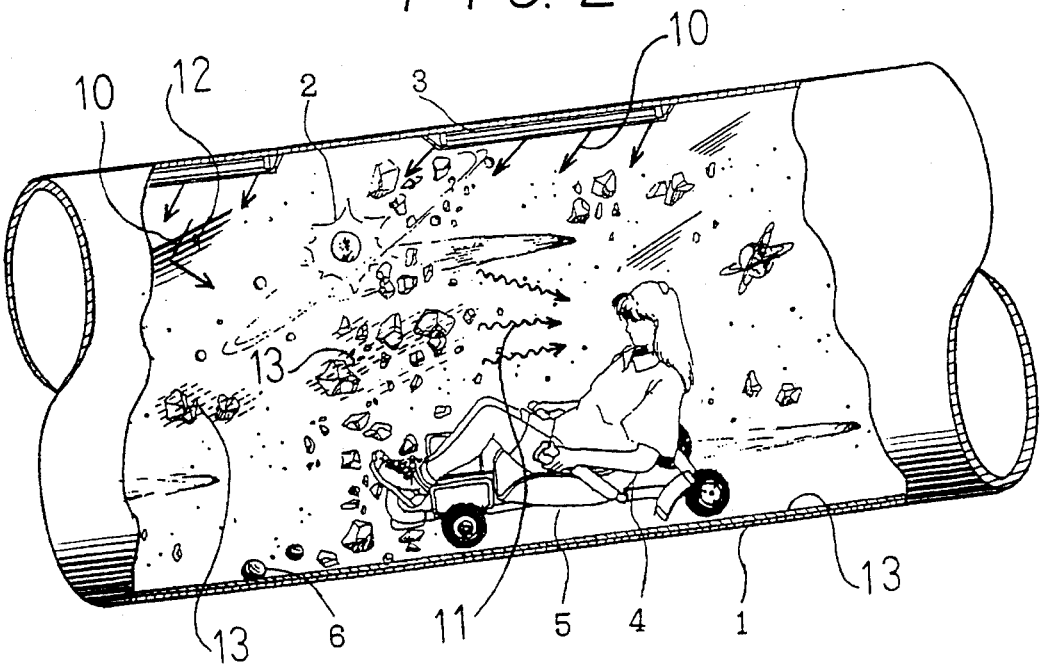
FIG. 2 is a fragmentary perspective illustration of a part of the tube of a preferred embodiment shown in FIG. 1.

FIG. 1 is a partial perspective illustration showing a preferred embodiment of the amusement device of the present invention and FIG. 2 is a fragmentary perspective illustration showing a part of the preferred embodiment shown in FIG. 1.

In this preferred embodiment, reference numeral 1 denotes a tubular passage in which a tube is formed into a circular section, reference numeral 2 denotes a picture drawn in such a way as a stereoscopic light emitting image can be attained at the inner wall surface of the tubular passage 1 with the fluorescent substance, reference numeral 3 denotes an illuminating device for radiating the ultraviolet rays and reference numeral 6 denotes the flowing members formed by the fluorescent substance.

A rider 4 rides on a cart 5 and runs through the dark tubular passage 1 where the flowing members 6 formed by fluorescent substance are flowing and descending.

The tubular passage 1 is not illustrated but this is constructed from the upper part to the lower part in such a way as the cart 5 having no driving power can run-down by its own weight and flowing members 6 formed by the fluorescent substance can freely descend by their own weights. The tubular passage 1 is formed by materials such as fiber reinforced plastics (FRP) or stainless steel (SUS) or fiber reinforced concrete (FRC) and the like and made into the tube having the circular section and at the same time the inner wall surface of the tube is formed into a reflection surface, reflecting the ultraviolet rays in an opposite direction against a normal line of the incident light and further formed in such a manner as the reflection of the ultraviolet rays is repeated within the tube. A shape of circle or ellipse is the most appropriate as a sectional shape of the tube in which the ultraviolet rays repeat their reflection within the tube and a balanced uniform lux can be attained on the inner wall surface but other shapes such as a round corner rectangular shape may cause the ultraviolet rays to repeat their reflection on the reflection surface of the inner wall surface of the closed tube.

The reflection surface 12 may be formed into a mirror surface where the ultraviolet rays are reflected against the inner wall surface of the tube or formed into a near mirror surface, and in view of safety or durability or economical reasons, the reflection surface of the gel-coated layer is formed by gel-coating resin, in case of the tubular passage 1 of FRP material, in such a way that the innermost surface shall act as the inner wall surface when the glass fiber and the synthetic resin material are alternately piled up to form the tube. The tubular passage 1 of SUS material may be formed into the reflection surface, economically needs not be so clean as the mirror surface, by a buffing finish on the inner wall surface of the tube and the tubular passage 1 of FRC material may also be finished by coating the inner wall surface or sticking the sheet material and the like to form the reflection surface of hard and smooth surface layer.

The amusement device to make the light emitted image not seen in the day time to be seen in the night time is constructed such that the tubular passage 1 is formed by transparent or translucent material and the amusement device to cause the light emitted image to be seen also in the day time is formed by opaque material not passing the visual light in order to keep the interior of the tubular passage 1 dark. The tubular passage 1 made of FRP material is constructed such that if pigment is input when the glass fiber material and the synthetic resin material are piled up to form the tube, the tube can be made into opaque light shielding member. In addition, the visual light can be prevented from entering into the tubular passage 1 with transparent material or opaque material by coating finish and the like.

Then, the picture 2 drawn on the inner wall surface of the tubular passage 1 in such a way as the stereoscopic light emitted image may be attained with the fluorescent substance may be drawn in such a way that fluorescent lights having different lightness are generated by using substance generating fluorescent light 11 upon receiving the radiation of the ultraviolet rays 10 or coating material solved with the former substance or mixed in a suspended state or printed or drawn on the sheet and sticked to the inner surface. As the drawn picture 2, it is preferable to use pictures such as scene pictures of universe space as shown in FIG. 1, for example, or although not illustrated, pictures capable of expecting a fantastic fluorescent light effect such as geometrical patterns for generating a mild and fantastic mood by emitting the fluorescent light having different lightness.

The pictures 2 drawn at the place where the cart 5 rides on it or the place where the stream 7 within the tubular passage 1 in another preferred embodiment to be described later are masked by the transparent sheet or transparent coating material 13 and the like through which the ultraviolet rays are passed so as to protect their surfaces and to prevent the drawn pictures 2 from being damaged.

The illuminating device 3 is an ultraviolet ray radiation lamp for radiating the ultraviolet rays to the pictures 2. The wave length of the aforesaid ultraviolet ray radiation lamp is in the ranges of 280 nm to 400 nm. The ultraviolet ray radiation lamp for the wave length less than 200 nm which may be easily absorbed by air or for the wave length ranges of 200 nm to 280 nm, which will affect a hard chemical action to the living things, shall be avoided. Within this wave length range are contained the ultraviolet rays of wave lengths of 280 nm to 350 nm which are called as a dorno ray or a health ray and assumed to be effective for human body.

In the drawings, although the illuminating devices 3 of the fluorescent ultraviolet rays rod-like lamps having at their lower surface the masking for shielding the direct light are spaced apart at the upper part of the tubular passage 1 and continuously installed. The type and installing position of each of the illuminating devices 3 are to be determined in reference to the combinations of the position suitable for illumination of the drawn pictures 2 and the lamps suitable for their fixing. For example, at the place where the running speed is high and the view point of the rider 4 is easily directed downward, the pictures 2 are arranged at the lower surface of the tubular passage 1, the illuminating devices 3 are fixed at the upper part of the tubular passage 1 and at the place where the running speed is relatively slow, the pictures 2 are arranged at the side surface or the top surface of the tubular passage 1 and the illuminating device 3 are fixed to the lower surface or the side surface of the tubular passage 1.

The illuminating devices 3 are provided with the transparent protection cover to allow passage of the ultraviolet rays radiation side in order to prevent the contact damage of the rider 4 or dispersion of the damaged lamps. Although not shown, the protection cover has a surface to be formed as a light shielding surface where the rider 4 advances so as to conceal the presence of the illuminating devices 3 against the eyes of the rider 4 advancing to improve the fantastic effect.

The flowing members 6 formed by the fluorescent substance for generating fluorescent light under the ultraviolet rays are made of fluorescent substance itself, or pieces covered over their surfaces by fluorescent substance or transparent material immersed with fluorescent substance and the like. The flowing members 6 formed by liquid fluorescent substance flow down the course in the tubular passage from the uppermost to the lowermost by themselves. The flowing members 6 formed into the spherical or flat-shaped solid material flow down the course, jumping or rolling.

Figure 3:
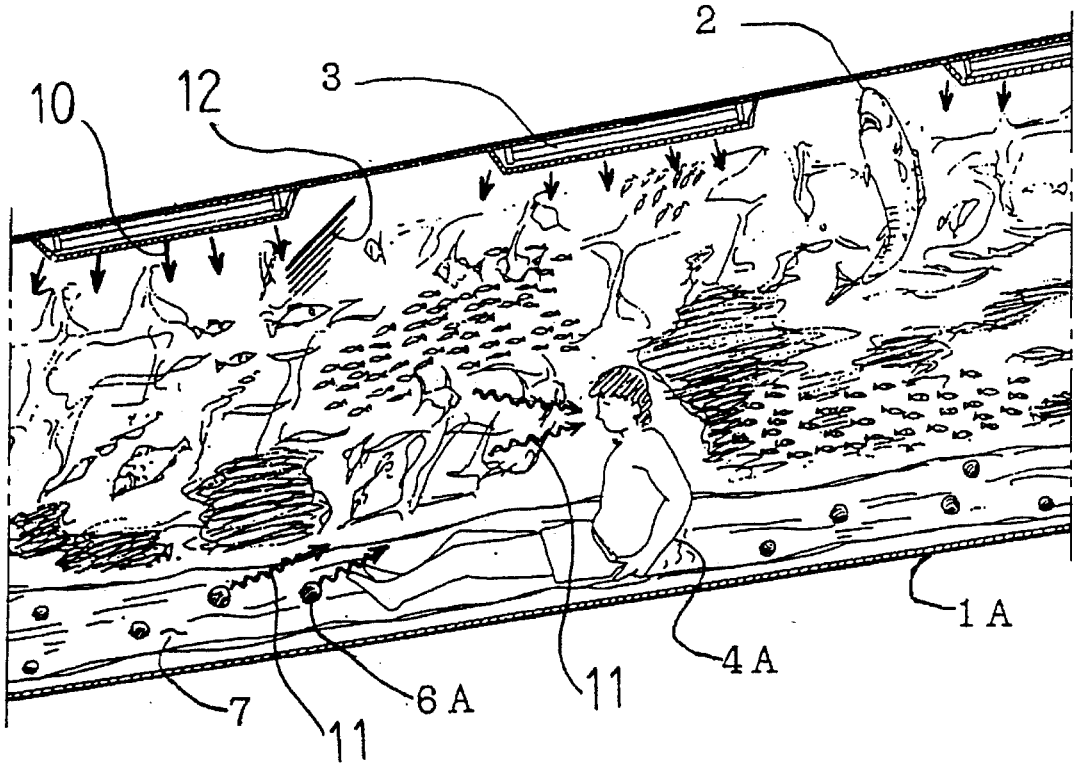
FIG. 3 is a fragmentary perspective illustration showing another preferred embodiment of the amusement device of the present invention.

FIG. 3 is a fragmentary perspective illustration snowing another embodiment of the tube 1A in which the rider 4A slides down within the tube 1A together with the stream 7. In this preferred embodiment, the flowing members 6A formed by various shaped solid fluorescent substances descending down the course from the uppermost to the lowermost, floating, sinking or dropping are used in the stream 7 within the tube 1A. However, instead of the above, the stream 7 into which the flowing members 6A having fluorescent substance are solved may be in addition, the flowing members 6A can be moved not only in one direction of their natural flowing-down but also ascended with air while being formed light and moved up and down.

The preferred embodiment shown in FIGS. 1 and 2 is the amusement device in which the rider 4 rides on the cart 5 within the tubular passage 1 arranged from the upper part to the lower part and runs there, although the preferred embodiment shown in FIG. 3 is the amusement device sliding together with the stream 7 within the tube 1A arranged from the upper part to the lower part. However, the present invention may similarly be applied to the amusement devices such as the dryslide sliding within the tube directly without using any water or the waterslide where the rider rides on a float floated on the stream or the device passing within the tube while ascending or descending by using a power transporting machine.

What is claimed is:

1. An amusement device passing within a tube, said amusement device comprising the following elements:

a) a tube having an interior passageway for passing a rider who is a person;

b) said interior passageway of said tube having an illuminating device on an inner wall to radiate ultraviolet rays;

c) said interior passageway of said tube having a reflecting surface to reflect said ultraviolet rays;

d) said reflecting wall surface having a picture which is formed from a fluorescent substance which emits light when contacted with ultraviolet rays;

e) said picture, which is formed from a fluorescent substance which emits light when contacted with ultraviolet rays, being drawn so that said picture emits light of different brightness and tone when contacted by reflected ultraviolet rays and direct ultraviolet rays.

2. An amusement device passing within a tube as defined in claim 1 wherein said tube is circular and is formed from an opaque, fiber reinforced material.

3. An amusement device passing within a tube as defined in claim 1 wherein said tube is formed from an opaque, fiber reinforced material.

4. An amusement device passing within a tube as defined in claim 1 wherein said picture being formed on the reflecting surface of said inner wall which is mirror like is formed on a gel-coated layer.

5. An amusement device passing within a tube as defined in claim 1 wherein said picture is covered by a protective, transparent layer which allows passage of ultraviolet rays from said illuminating device and fluorescent light generated by said picture.

6. An amusement device passing within a tube as defined in claim 1 wherein the ultraviolet rays are of wavelengths of from 280 nm to 400 nm.

7. An amusement device passing within a tube, said amusement device comprising:

a) a tube extending from an upper part to a lower part, said tube being sized to pass a rider who is a person;

b) said interior passageway of said tube having an illuminating device to radiate ultraviolet rays;

c) said interior passageway of said tube having a reflecting surface on an inner wall to reflect said ultraviolet rays;

d) a flowable substance in said tube, said flowable substance containing solid fluorescent substances having different shapes which emit light of different brightness and tone when contacted by reflected ultraviolet rays and direct ultraviolet rays.

8. An amusement device passing within a tube as defined in claim 1 wherein the flowable substance is a liquid which moves by gravity from said upper part of said tube to said lower part of said tube and said solid fluorescent substances having different shapes float in said liquid.

9. An amusement device passing within a tube which comprises:

a) a tube extending from an upper part to a lower part and having a tubular interior passage to allow a rider who is a person to pass;

b) said interior passageway of said tube having an illuminating device to radiate ultraviolet rays;

c) said interior passageway of said tube having a reflecting surface on an inner wall to reflect said ultraviolet rays;

d) said inner wall having a picture which is drawn with a plurality of fluorescent substances;

e) a flowable substance in said tube, said flowable substance containing solid fluorescent substances having different shapes which emit light of different brightness and tone when contacted by reflected ultraviolet rays and direct ultraviolet rays.

* * * * *